US010355402B2

(12) United States Patent
Degner et al.

(10) Patent No.: US 10,355,402 B2
(45) Date of Patent: Jul. 16, 2019

(54) AXISYMMETRIC MAGNETIC ARTICULATING CONNECTOR

(71) Applicant: Apple Inc., Cupertino, CA (US)

(72) Inventors: Brett W. Degner, Menlo Park, CA (US); Bradley J. Hamel, Redwood City, CA (US); Christopher J. Stringer, Woodside, CA (US); Christiaan A. Ligtenberg, San Carlos, CA (US); David H. Narajowski, Los Gatos, CA (US); Kristopher P. Laurent, Campbell, CA (US); Mahmoud R. Amini, Sunnyvale, CA (US); Michael E. Leclerc, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/720,165

(22) Filed: Sep. 29, 2017

(65) Prior Publication Data

US 2019/0103701 A1 Apr. 4, 2019

(51) Int. Cl.

*H01R 13/03* (2006.01)
*H01R 13/24* (2006.01)
*H01R 13/62* (2006.01)

(52) U.S. Cl.

CPC ..... *H01R 13/6205* (2013.01); *H01R 13/03* (2013.01); *H01R 13/2407* (2013.01)

(58) Field of Classification Search

CPC .... H01R 13/6205; H01R 11/30; H01R 13/03; H01R 13/2407

USPC ..... 439/39, 38, 6, 8

See application file for complete search history.

(56) References Cited

U.S. PATENT DOCUMENTS 2,117,967 A * 5/1938 Albin ..... F21L 4/00 362/105
2,404,564 A * 7/1946 Boehlke ..... H01R 35/04 285/907
2,519,933 A * 8/1950 Rouault ..... H01P 1/064 174/21 JC
4,025,964 A * 5/1977 Owens ..... A61M 39/0247 128/899
4,947,846 A * 8/1990 Kitagawa ..... A61B 5/0408 600/391
4,978,306 A * 12/1990 Robb ..... H01R 35/04 439/592
5,606,237 A 2/1997 Biasotti et al.
5,980,290 A * 11/1999 Meynier ..... H01R 13/6315 439/246
6,267,602 B1 * 7/2001 Mendelson ..... H01R 13/6205 439/38

(Continued)

OTHER PUBLICATIONS

"Presto 9984 Control Master Heat Control with Magnetic Cord," obtained from http://www.cookingandcanning.net/pr99comaheco.html, generated Jan. 18, 2006, 1-pg.

(Continued)

*Primary Examiner* — Gary F Paumen

(74) *Attorney, Agent, or Firm* — Kilpatrick Townsend & Stockton, LLP

(57) ABSTRACT

Connector inserts and connector receptacles that have a small form factor, readily mate when brought into proximity to each other, and disconnect when subjected to a non-axial force.

19 Claims, 10 Drawing Sheets

(56) References Cited

U.S. PATENT DOCUMENTS

| | | | | |
|---|---|---|---|---|
| 7,175,441 | B2 * | 2/2007 | Naviaux | F21V 19/02 362/421 |
| 7,311,526 | B2 | 12/2007 | Rohrbach et al. | |
| 7,625,213 | B1 * | 12/2009 | Tse | H01R 13/6205 439/22 |
| 8,888,500 | B2 | 11/2014 | Gao et al. | |
| 9,065,205 | B2 | 6/2015 | Gao et al. | |
| 2009/0154883 | A1 * | 6/2009 | Robb | G02B 6/3604 385/56 |
| 2011/0081788 | A1 * | 4/2011 | Robb | G02B 6/3604 439/8 |
| 2014/0065845 | A1 * | 3/2014 | Ando | H01R 24/46 439/38 |
| 2014/0273546 | A1 * | 9/2014 | Harmon | H01R 13/6205 439/39 |
| 2016/0127643 | A1 * | 5/2016 | Huerta | H04N 5/23241 348/211.2 |
| 2017/0250578 | A1 * | 8/2017 | Kallman | H02J 50/90 |

OTHER PUBLICATIONS

National Presto Industries, Inc., "Magnetic Cord for Electric Deep Fryers," obtained from http://www.gopresto.com/productslproductslphp?stock=09982. generated Jan. 18, 2006, 1-pg.

Dowell Trading Co, Ltd.,"News for Break Away Power Cords on Electric Deep Fryers," copyright 2002, 1-pg.

CNN.com, "Break-away cord aims to make deep fryers safer," obtained from http:/larchives.cnn.com/2001/US/07/03/deep.fryers/, dated Jul. 4, 2001, 2-pgs.

"Zojirushi Hot Water Dipensing Pot Review," obtaind from http://www.pkshiu.comtlof/archive/2005/01/zojirusji-hot-water-dispensing--pot.cndot.review, dated Jan. 5, 2005, 2-pgs.

U.S. Consumer Product Satety Commission, "Consumer Product Safety Review," Winter 2002, vol. 6, No. 3, total of 12-pgs., see p. 5.

International Search Report and Witten Opinion mailed Feb. 4, 2019 in International Patent Application No. PCT/US2018/048972, 21 pp.

* cited by examiner

AXISYMMETRIC MAGNETIC ARTICULATING CONNECTOR

BACKGROUND

The number and types of electronic devices available to consumers have increased tremendously the past few years and this increase shows no signs of abating. Devices such as portable computing devices, tablets, desktops, and all-in-one computers, smart phones, storage devices, portable media players, navigation systems, monitors and other devices have become ubiquitous.

These devices often transfer power and data using cables that may have connector inserts on each end. The connector inserts may plug into connector receptacles on electronic devices, thereby forming one or more conductive paths for power, data, or both power and data.

But these connector inserts and connector receptacles may be relatively large. A sizeable connector receptacle may consume an undesirably large space in an electronic device housing the connector receptacle. This may reduce the functionality that may be provided by the electronic device, it may increase the size of the electronic device, or a combination of both.

Users may plug connector inserts into connector receptacles in different devices several times a day as they charge their laptops, phones, tablets, and other devices. Accordingly, it may be desirable to simplify the connection procedure used to form a connection. Thus, it may be desirable that a connection between a connector insert and a connector receptacle be readily formed when the connector insert is brought into proximity to the connector receptacle.

The connection between a connector insert and a connector receptacle may undergo inadvertent non-axial forces during use. That is, a cable attached to a connector insert that is inserted into a connector receptacle of an electronic device may be tripped over or experience other inadvertent force. When this happens, it may be desirable that the connector insert and connector receptacle disconnect without damage being incurred by either the connectors or the electronic device.

Thus, what is needed are connector inserts and connector receptacles that have a small form factor, readily mate with each other when brought into proximity, and disconnect when subjected to a non-axial force.

SUMMARY

Accordingly, embodiments of the present invention may provide connector inserts and connector receptacles that have a small form factor, readily mate with each other when brought into proximity, and disconnect when subjected to a non-axial force.

Users may plug connector inserts into connector receptacles housed in electronic devices several times a day. Accordingly, embodiments of the present invention may provide connector systems where a connector insert may readily mate with a connector receptacle when the connector insert is brought into proximity to the connector receptacle. The connector insert may be mated with the connector receptacle along a connection axis. In these and other embodiments of the present invention, mating portions of the connector insert and connector receptacle may be axisymmetrical. This may allow the connector insert to mate with the connector receptacle at any rotation around the connection axis. As a result, a connector insert, once mated, may rotate 360 degree around the connection axis without losing connection to the connector receptacle. In these and other embodiments of the present invention, the connector insert may also be connected when is has a tilt relative to the connection axis. In these and other embodiments of the present invention, the connector insert may be inserted with a tilt of 10 degrees relative to the connection axis. In these and other embodiments of the present invention, the connector insert may be inserted with a tilt of 15 degrees relative to the connection axis. In these and other embodiments of the present invention, the connector insert may be inserted with a tilt of 20 degrees relative to the connection axis. The tilt may be in any direction about the connection axis. Also, once mated, the connector insert may be tilted these amounts in any direction without breaking a connection with the connector receptacle.

Conventional connector inserts and connector receptacles may be relatively large. A sizable connector receptacle may result in an electronic device having less functionality, a larger size, or a combination of both. Accordingly, embodiments of the present invention may provide connector inserts that may include an axisymmetrical tip that may be inserted in an opening in a connector receptacle. The opening of the connector receptacle may be formed of an opening of a magnetic yoke that may guide the tip of the insert into the opening and may then hold the insert in place. This arrangement may reduce a size of a connector receptacle, as well as the connector insert.

These and other embodiments of the present invention may provide connector systems that convey power. These and other embodiments of the present invention may also, or instead, provide data. For example, intermediate frequency or radio frequency data may be added to a power supply and conveyed over the same path. In these and other embodiments of the present invention, power and data may be time multiplexed. For example, power may be provided during a first time slot, while data is provided during a second time slot. In these and other embodiments of the present invention, a connector insert and connector receptacle may include additional signal or power paths, or both. In these and other embodiments of the present invention, the connector insert and connector receptacle may include one or more fiber-optic paths.

Again, a cable attached to a connector insert that is inserted in a connector receptacle of an electronic device may undergo various inadvertent forces. It may be desirable these inadvertent forces do not cause damage to either the connectors or the electronic device. Accordingly, these and other embodiments of the present invention may provide a connector insert the may disconnect from a connector receptacle after receiving a non-axial force.

In various embodiments of the present invention conductive portions the connector systems may be formed by stamping, forging, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The magnets may be rare-earth magnets or other type of magnets.

Embodiments of the present invention may provide connector receptacles and connector inserts that may be located in, may connect to, or may be on the surface of various types of devices, such as portable computing devices, tablet computers, desktop computers, laptop computers, all-in-one computers, wearable computing devices, cell phones, smart phones, media phones, storage devices, portable media players, wearable computing devices, navigation systems, monitors, power supplies, video delivery systems, adapters, styluses, remote control devices, chargers, and other devices. These connector receptacles and connector inserts may provide pathways for signals that are compliant with various standards such as one of the Universal Serial Bus (USB) standards including USB Type-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide connector receptacles and connector inserts that may be used to provide a reduced set of functions for one or more of these standards. In various embodiments of the present invention, these connector receptacles and connector inserts may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
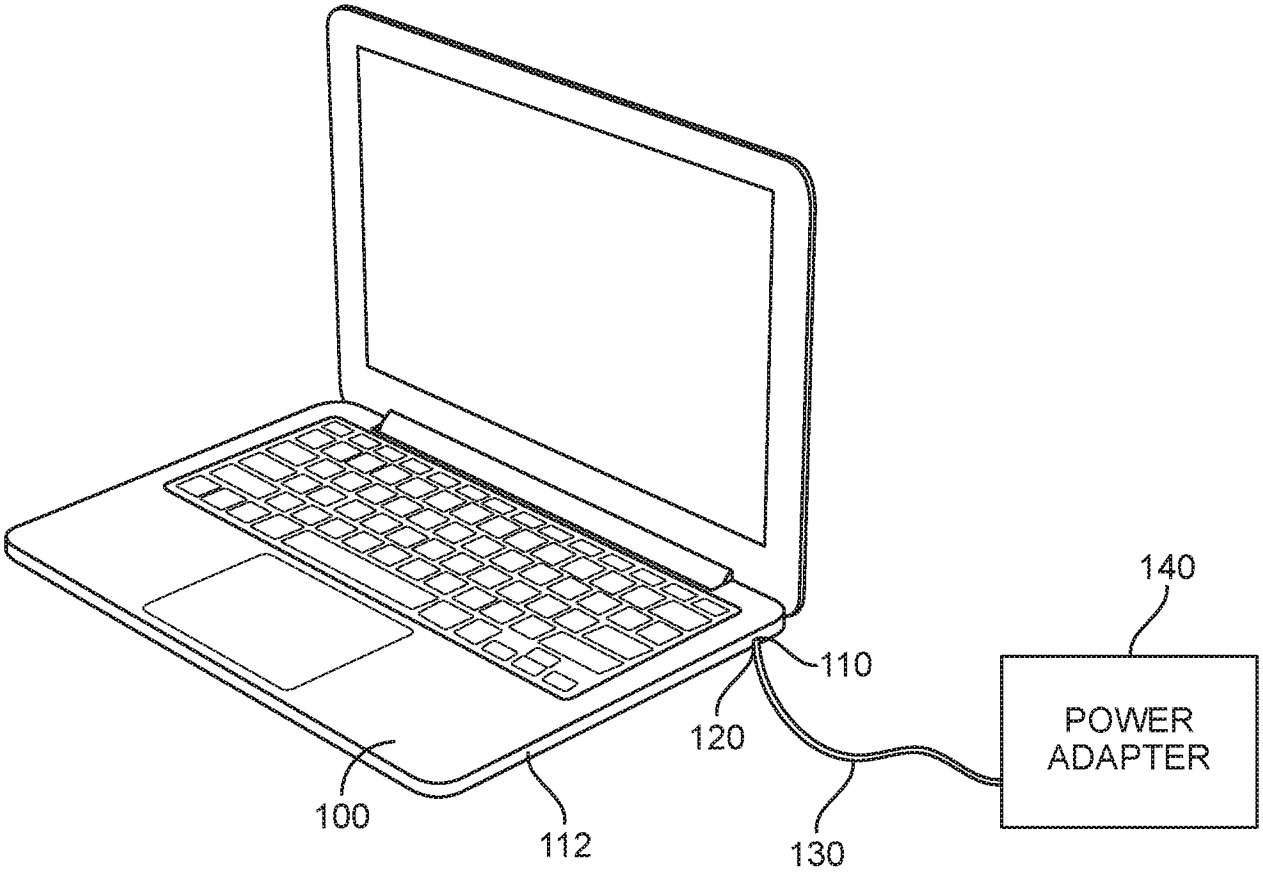
FIG. 1 illustrates an electronic system that may be improved by the incorporation of embodiments of the present invention.

FIG. 1 illustrates an electronic system that may be improved by the incorporation of embodiments of the present invention. This figure, as with the other included figures, is shown for illustrative purposes and does not limit either the possible embodiments of the present invention or the claims.

This figure includes electronic device 100. In this specific example, electronic device 100 may be a laptop computer. In other embodiments of the present invention, electronic device 100 may be a portable computing device, tablet computer, smart phone, global positioning device, wearable computing device, media player, or other device.

Electronic device 100 may include a battery. The battery may provide power to electronic circuits in electronic device 100. This battery may be charged using power adapter 140. Specifically, power adapter 140 may receive power from an external source, such as a wall outlet or car charger. Power adapter 140 may convert received external power, which may be AC or DC power, to DC power, and it may provide the converted DC power over cable 130 to connector insert 120. Connector insert 120 may be arranged to mate with connector receptacle 110 on electronic device 100. Power may be received at connector receptacle 110 from connector insert 120 and provided to the battery and electronic circuitry in electronic device 100. In other embodiments of the present invention, data or other types of signals may also be provided to electronic device 100 via connector insert 120 and connector receptacle 110. Examples of connector insert 120 and connector receptacle 110 are shown below.

Again, users may plug connector inserts into connector receptacles in electronic devices several times a day. Accordingly, embodiments of the present invention may provide connector systems where a connector insert 120 may readily mate with a connector receptacle 110 when the connector insert 120 is brought into proximity to the connector receptacle 110. In these and other embodiments of the present invention, connector insert 120 may be mated with connector receptacle 110 along a connection axis. Connector insert 120 may mate with the connector receptacle 110 at any rotation around the connection axis. In these and other embodiments of the present invention, connector insert 120 may also be inserted when it has a tilt relative to the connection axis. An example is shown in the following figure.

Figure 2:
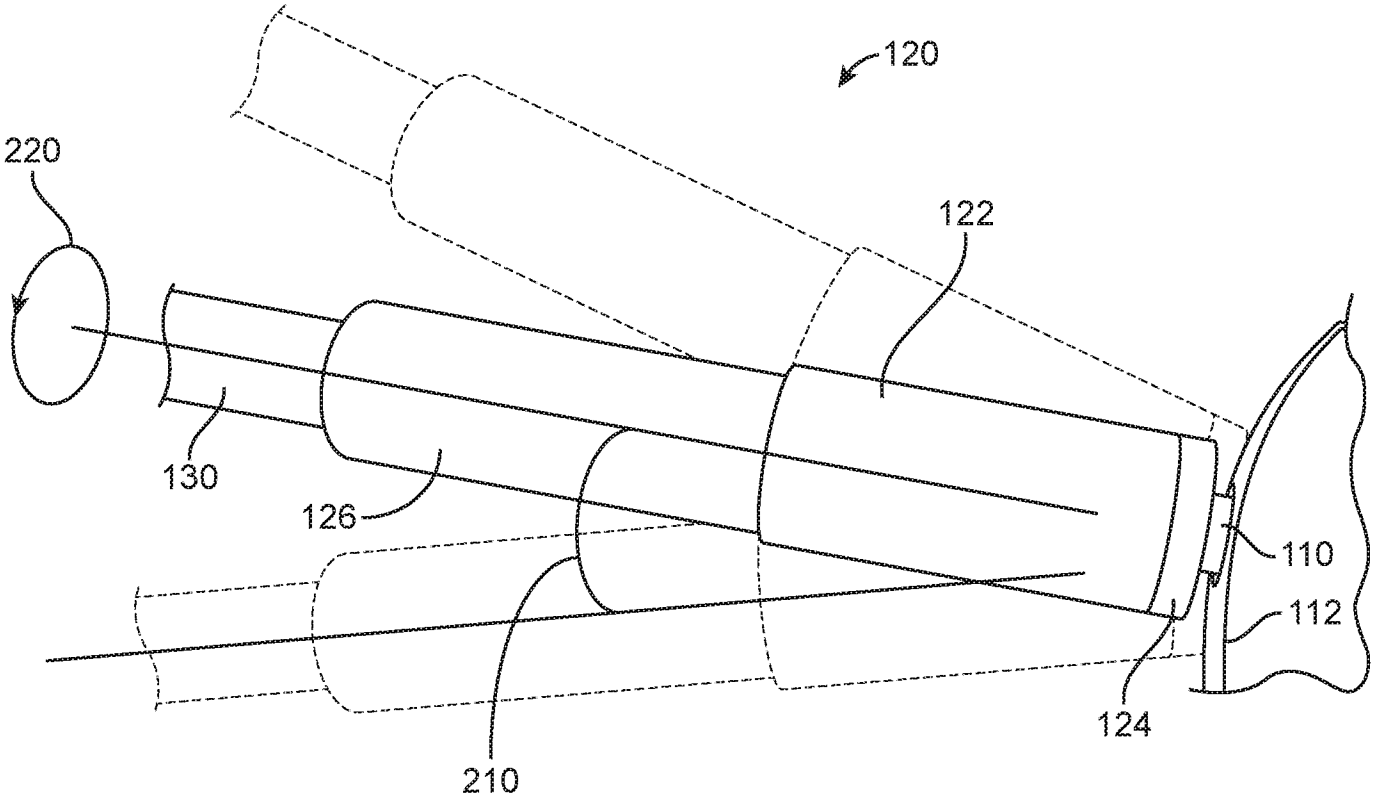
FIG. 2 illustrates a connector system according to an embodiment of the present invention.

FIG. 2 illustrates a connector system according to an embodiment of the present invention. In this example, connector insert 120 may include insulating region 124 and housing or shielding 122. Connector insert 120 may connect to cable 130. Cable 130 may be protected by strain relief 126. Connector receptacle 110 may be located in electronic device enclosure 112.

Connector insert 120 may connect to connector receptacle 110 along connection axis 210. Connector insert 120 may be inserted in any rotation 230 about connection axis 210. Connector insert 120 may also be inserted when it has a tilt relative to connection axis 210. That is, connector insert 120 may have a tilt at angle 220 relative to connection axis 210 when it is inserted. This tilt may be in any direction about connection axis 210. In these and other embodiments of the present invention, the angle 220 may be 10 degrees. In these and other embodiments of the present invention, the angle 220 may be 15 degrees. After mating, connector insert 120 may also be titled these amounts without breaking a connection to connector receptacle 110.

Figure 3:
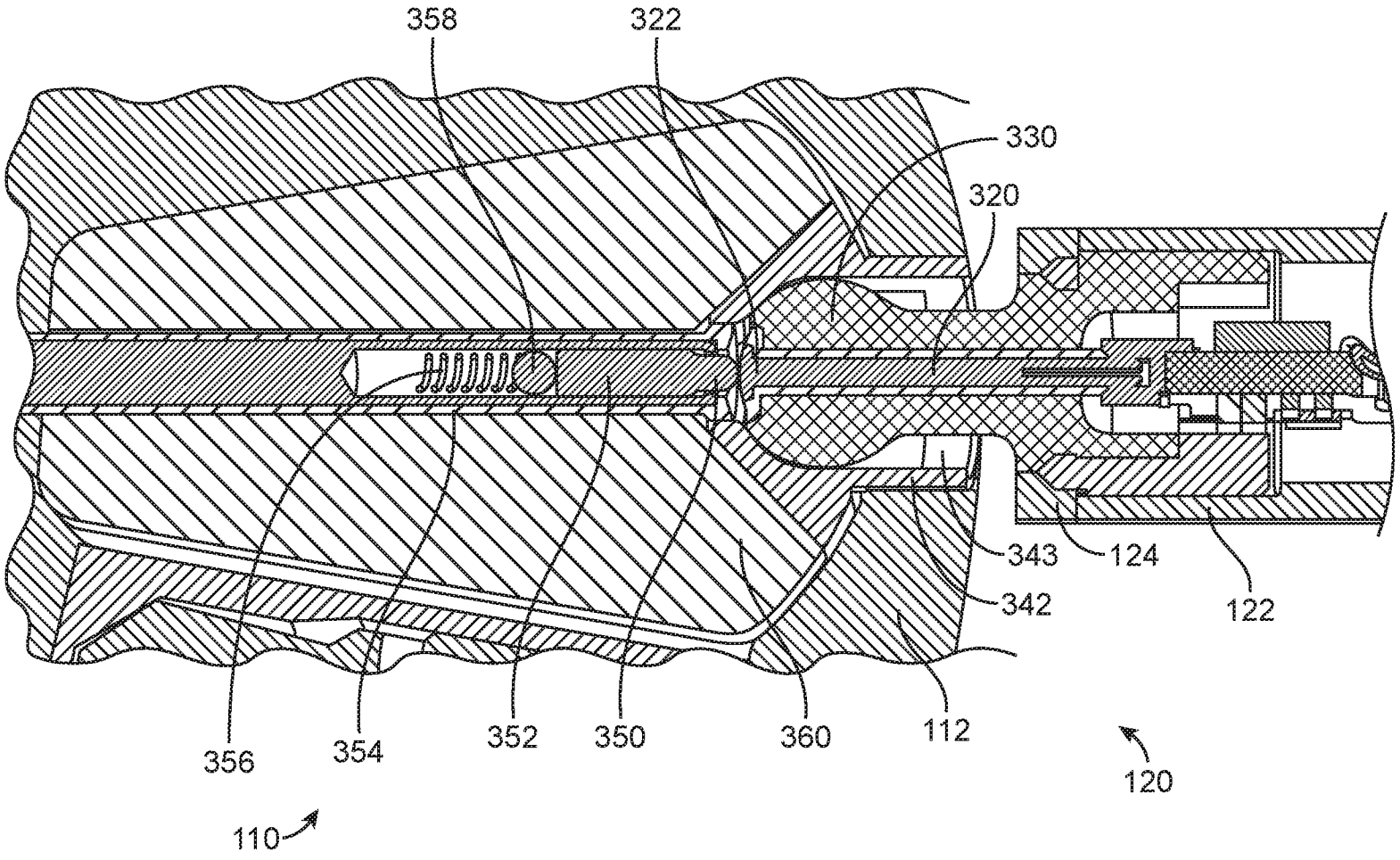
FIG. 3 illustrates a more detailed view of a connector system according to an embodiment of the present invention.

Conventional connector inserts and connector receptacles may be relatively large. A sizable connector receptacle may result in an electronic device having less functionality, a larger size, or a combination of both. Accordingly, embodiments of the present invention may provide connector inserts that may include an axisymmetrical tip that may be inserted in an opening in a connector receptacle. This arrangement may reduce a size of a connector receptacle, as well as the connector insert. An example is shown in the following figure FIG. 3 illustrates a more detailed view of a connector system according to an embodiment of the present invention. Connector receptacle 110 may be housed in device enclosure 112. Connector receptacle 110 may include magnet 360. Magnet 360 may be located in yoke 500 (shown in FIGS. 5 and 6) that may include a front portion 342 defining opening 343 at the front of connector receptacle 110. Front portion 342 and opening 343 may be axisymmetrical about the connection axis 210 (shown in FIG. 2.) A contact may be present in opening 343. In this example, spring-loaded contact 350 may have a tip of plunger 352 at opening 343. Spring-loaded contact 350 may further include spring 356 in housing 354. A sphere or other object 358 may operate with a sloped backside to plunger 352 to ensure that plunger 352 remains in contact with housing 354. This may prevent receptacle currents from flowing exclusively through spring 356, which might be sufficient to destroy spring 356.

Connector insert 120 may include tip 330. Tip 330 may have a generally spherical shape, though in these and other embodiments of the present invention, tip 330 may have other shapes. Tip 330 may be axisymmetrical about the connection axis 210 (shown in FIG. 2.) Tip 330 may include central conductor 320. Central conductor 320 may terminate in contact 332, which may form an electrical connection with spring-loaded contacts 350 in connector receptacle 110 when connector insert 120 is mated with connector receptacle 110. Connector insert 120 may include insulating region 124 in front of housing or shield 122 to protect device enclosure 112 from connector insert 120. Housing or shield 122 may provide a surface to be manipulated by a user. It may also provide electromagnetic shielding for connector insert 120.

Figure 4:
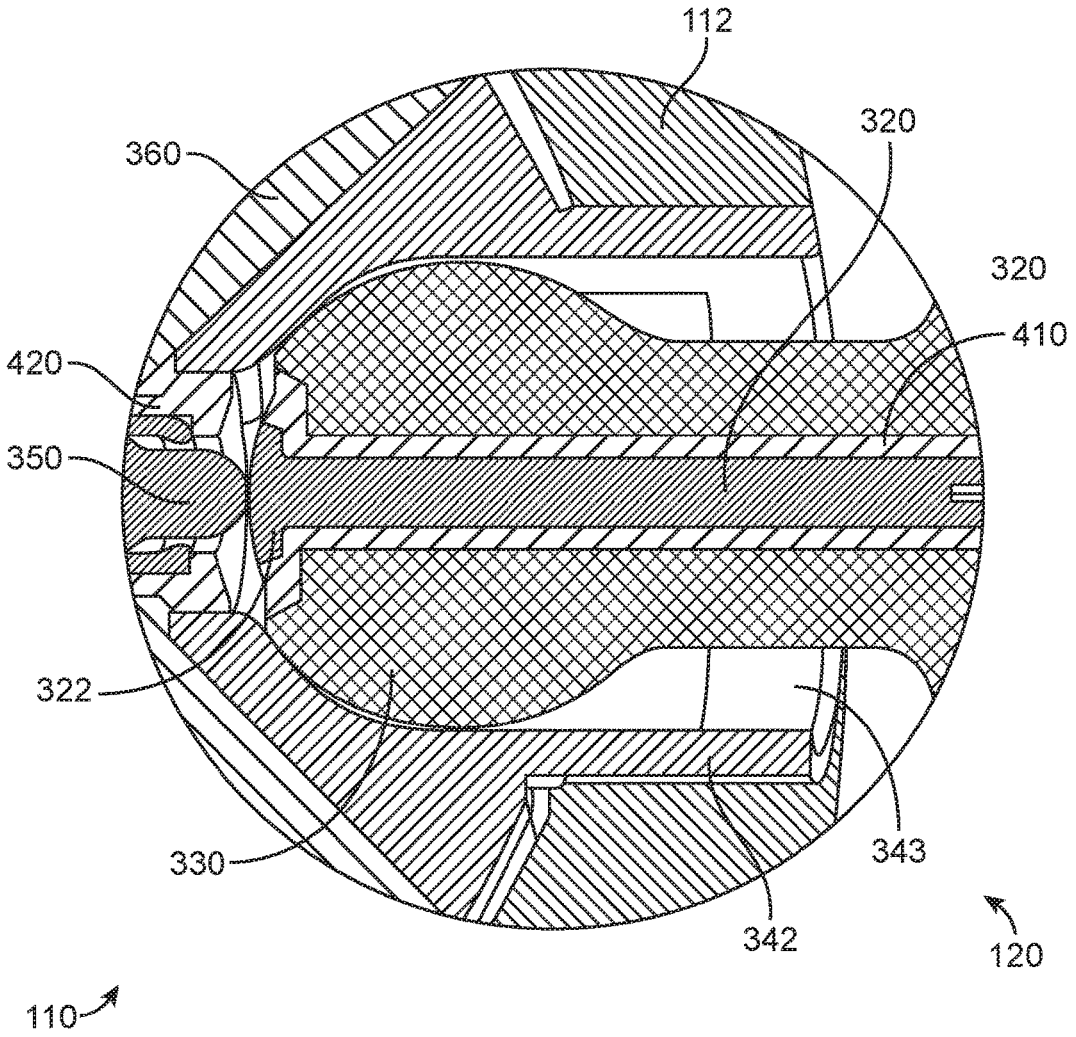
FIG. 4 is a close-up of the connector system of FIG. 3.

FIG. 4 is a close-up of the connector system of FIG. 3. In this example, connector receptacle 110 may include spring-loaded contact 350. Spring-loaded contact 350 may be insulated from magnet 360 by insulating layer 420. Yoke 500 (shown in FIGS. 5 and 6) may include front portion 342 defining opening 343. Connector insert 120 may include a connector tip 330 having a central conductor 320. Central conductor 320 may terminate at contact 322, which may electrically connect to spring-loaded contact 350 in connector receptacle 110. Central conductor 320 may be insulated by insulating layer 410.

These and other embodiments of the present invention may provide connector systems that may convey power. For example, central conductor 320 of connector insert 120 and spring-loaded contact 350 of connector receptacle 110 may convey a power supply, while front portion 342 of yoke 500 in connector receptacle 110 and the remainder of tip 330 of connector insert 120 may provide a ground or return path. During mating, the ground of tip 330 may connect to front portion 342 of yoke 500 to form a ground connection before the power is connected through spring-loaded contact 350 and contact 322. In these and other embodiment of the present invention, data may also be sent over this power connection, or data may be sent instead of power. For example, intermediate frequency or radiofrequency data may be added to the power supply voltage and conveyed over the same path. In these and other embodiments of the present invention, other data-over-power techniques may be used. In these and other embodiments of the present invention, data and power may be time multiplexed. That is, this connection may be used during a first time slot for data and during a second time slot for power. In these and other embodiments of the present invention, central conductor 320 and spring-loaded contact 350 may be replaced by fiber-optic connections. In these and other embodiments of the present invention, more than one conductor 320 may be used to electrically convey data and power simultaneously.

In these and other embodiments of the present invention, connector insert 120 and connector receptacle 110 may be formed of various materials. For example, tip 330 of connector insert 120 may be formed of a steel or other material that is both magnetically and electrically conductive. This may allow tip 330 to be attracted to a magnetic field generated by magnet 360 and directed or guided by yoke 500, while also providing a reasonably low-resistance path for the ground or return current. Magnet 360 may be a rare earth or other type of magnet. Spring-loaded contact 350 may be formed of copper, brass, or other materials.

These and other embodiments of the present invention may employ one or more magnets or magnetically conductive structures to assist a user in connecting connector insert 120 to connector receptacle 110. These magnets and structures may provide an increasing level of magnetic attraction as a tip of connector insert 120 is brought into an opening in a yoke at a front of a connector receptacle 110. This increasing level of magnetic attraction may ensure that a mating connection is made when a user brings connector insert 120 into proximity to a connector receptacle 110. An example is shown in the following figures.

Figure 5:
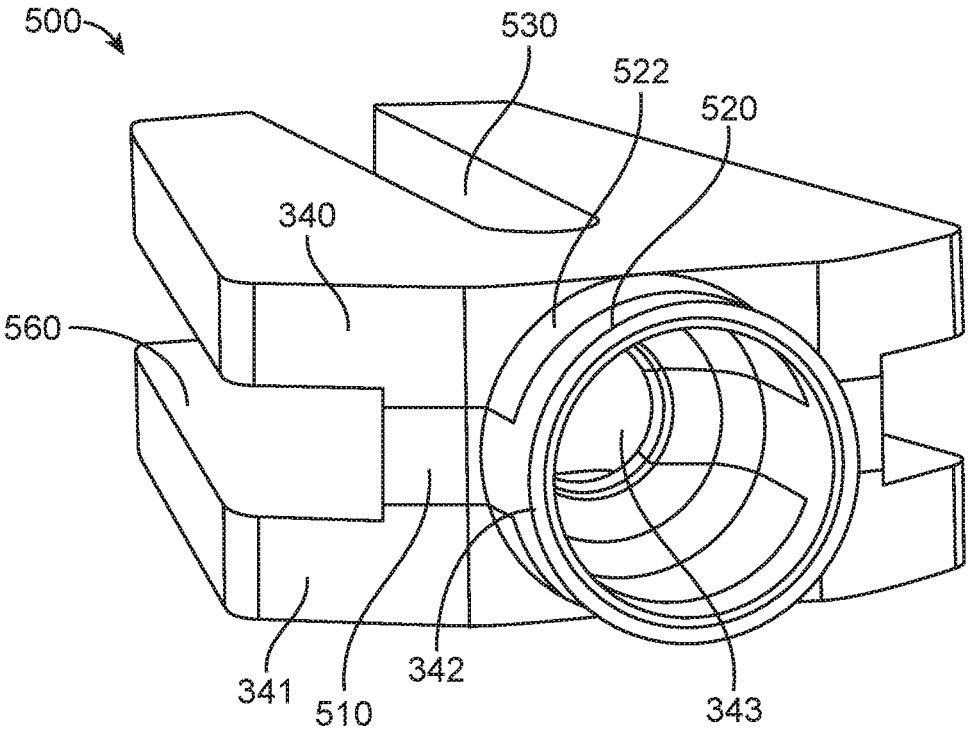
FIG. 5 illustrates a yoke for a connector receptacle according to an embodiment of the present invention.

FIG. 5 illustrates a yoke for a connector receptacle according to an embodiment of the present invention. Yoke 500 may be a bi-metallic yoke formed of three layers, though these and other embodiments of the present invention may provide yokes having one, two, four, or more than four layers. This example includes a top ferritic layer 340 and a bottom ferritic layer 341. Top ferritic layer 340 and bottom ferritic layer 341 may be formed of iron cobalt or other ferritic material such as 430, 434, or other ferritic stainless steel. Yoke 500 may further include an intermediate non-ferritic layer 510. Intermediate non-ferritic layer 510 may be formed of non-ferritic material, such as 316, 316L, or other non-ferritic stainless steel. In these and other embodiments of the present invention, these layers may be laminated, brazed, soldered, or otherwise manufactured to form a unit. In these and other embodiments of the present invention, yoke 500 may be manufactured by a double shot metal injection manufacturing process. The top ferritic layer 340, bottom ferritic layer 341, and intermediate non-ferritic layer 510 may be co-machined and finished. This may provide a smooth surface for opening 343. This in turn may help to prevent binding between tip 330 of connector insert 120 and connector receptacle 110.

Yoke 500 may include a front collar or front portion 342. Front portion 342 may define an opening 343 through which a contact in the connector receptacle may be accessed by a tip of a corresponding connector insert. Front portion 342 may include concentric ring 520 formed by non-ferritic layer 510, and ring portions 522 formed of top ferritic layer 340 and bottom ferritic layer 341. Magnet 360 (shown in FIG. 3) may include a passage for spring-loaded contact 350. Slot 530 in yoke 500 may be aligned to that passage in magnet 360. Slot 530 may be optional and not included, such as in the example shown in FIG. 6.

Figure 6:
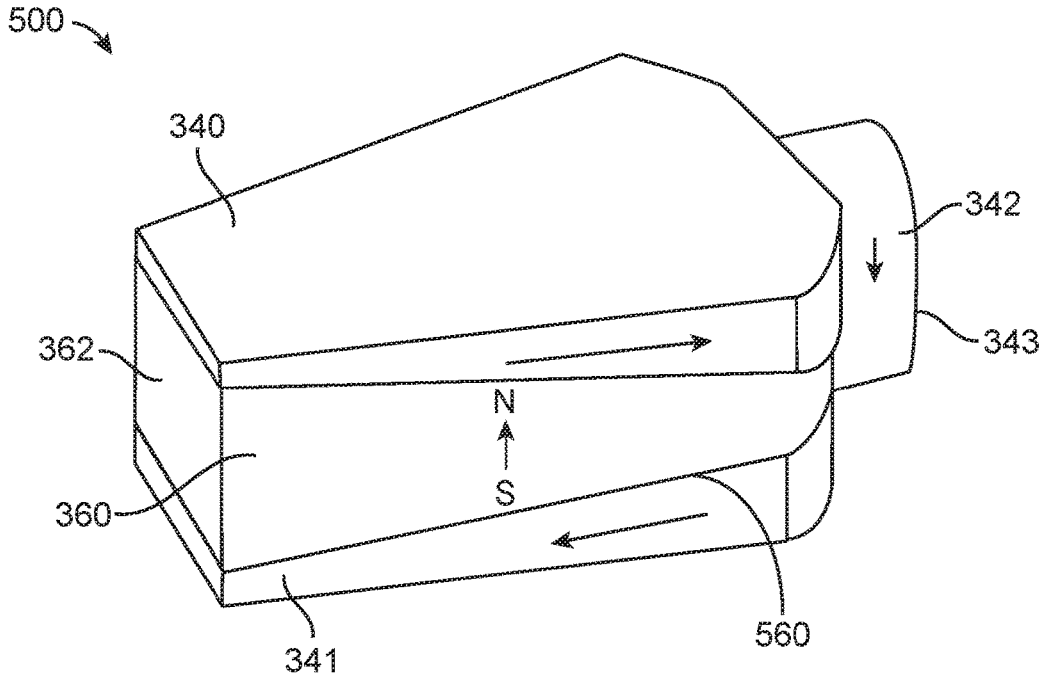
FIG. 6 illustrates the yoke of FIG. 5 along with a magnet.

Top ferritic layer 340 and bottom ferritic layer 341 may be arranged to convey opposing magnetic field lines provided by magnet 360 (shown in FIGS. 3 and 6). Magnet 360 may be located in slot 560 between top ferritic layer 340 and bottom ferritic layer 341. As tip 330 (shown in FIG. 3) of connector insert 120 is brought into proximity to front portion 342, tip 330 may be magnetically attracted to front portion 342. In these and other embodiments of the present invention, the magnetic field strength may be limited by the presence of non-ferritic ring 520 such that tip 330 does not form a stable magnetic attraction to an outside surface of device enclosure 112. As tip 330 enters opening 343, magnetic field lines from top ferritic layer 340 may pass through tip 330 of connector insert 120 and then back into bottom ferritic layer 341. This magnetic pathway may conduct more field lines as tip 330 progresses into opening 343 a front portion 342. This increasing field strength may provide a feeling that connector receptacle 110 is pulling connector insert 120 into opening 343. This may provide a "blind mating" where a connection is readily made when connector insert 120 is in proximity with connector receptacle 110.

In this way, the field strength provided by yoke 500 may not be sufficient to attach tip 330 of connector insert 120 to device enclosure 112. However, as tip 330 of connector insert enters opening 343 in front portion 342, the magnetic attraction may increase thereby pulling tip 330 of connector insert 120 into connector receptacle 110 and forming a connection.

FIG. 6 illustrates the yoke of FIG. 5 along with a magnet. In this example, magnet 360 may be inserted into yoke 500 in slot 560. Magnet 360 may have a first pole, North in this example, alongside top ferritic layer 340, and a second pole, South, alongside bottom ferritic layer 341. Field lines from the North pole of magnet 360 may travel through top ferritic layer 340 towards front portion 342 of yoke 500. Without connector insert 120, magnetic field lines may pass through ring portions 522 (shown in FIG. 5) of front portion 342. After passing through front portion 342, the field lines may return through bottom ferritic layer 341 towards the south pole of magnet 360.

Tip 330 of connector insert may be a ferritic stainless steel or other magnetically conductive material. For example, it may be a material that conducts both electricity and magnetic field lines fairly well. Accordingly, when tip 330 of connector insert 120 is brought into opening 343, tip 330 may conduct magnetic field lines from top ferritic layer 340 to bottom ferritic layer 341. This conduction may increase as tip 330 is pulled further into opening 343 of yoke 500. In this way, tip 330 may close the field lines from magnet 360 between top ferritic layer 340 to bottom ferritic layer 341. Again, this may provide for blind mating between connector insert 120 and connector receptacle 110.

In these and other embodiments of the present invention, magnet 360 may taper in thickness from a rear 362 of magnet 360 to front portion 342. This may allow top ferritic layer 340 and bottom ferritic layer 341 to widen near front opening 343. This may reduce stray flux from yoke 500. That is, the increasing width of top ferritic layer 340 and bottom ferritic layer 341 may compensate for the increasing field strength near the front opening 343.

In these and other embodiments of the present invention, a width of magnet 360 and yoke may narrow towards a rear 362 of magnet 360. This may help to save space in a device. In these and other embodiments of the present invention, magnet 360 and yoke may have a more rectangular or other shaped width.

In these and other embodiments of the present invention, yoke 500 and magnet 360 may be located in a thin device where a surface of the device is near a top or bottom of yoke 500. In such a device, top ferritic layer 340 and bottom ferritic layer may limit flux such that connector insert 120 might not inadvertently become attached at the surface of the device.

In these and other embodiments of the present invention, other structures may be used in place of or along with yoke 500 and magnet 360. For example, a single magnet may be used without a yoke. In these and other embodiments of the present invention, two or more magnets may be used, either with or without a yoke.

Figure 7:
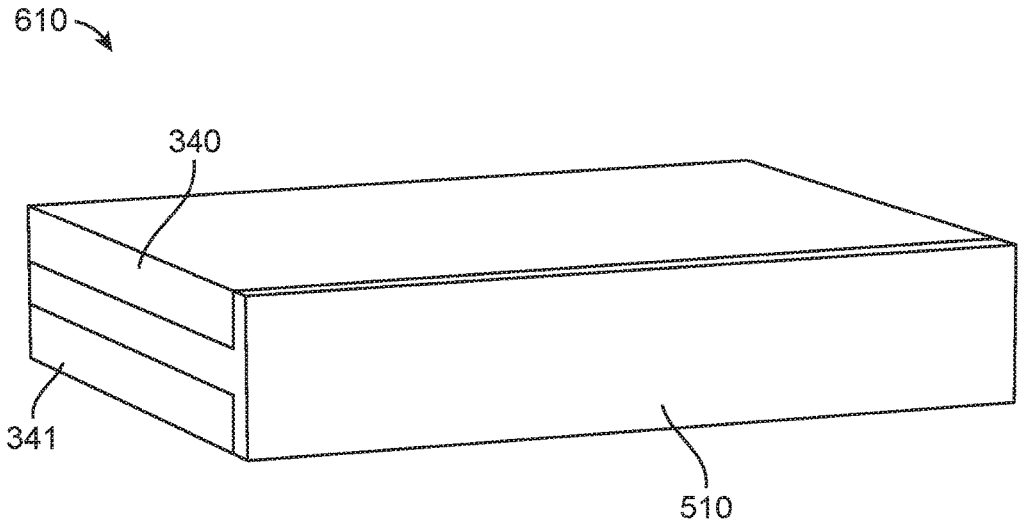
FIG. 7 illustrates a block that may be used in forming a yoke for a connector receptacle according to an embodiment of the present invention.

FIG. 7 illustrates a block that may be used in forming yoke 500 according to an embodiment of the present invention. In this example, block 610 may include a top ferritic layer 340, a bottom ferritic layer 341, and an intervening non-ferritic layer 510. A front surface of block 610 may also be formed of the non-ferritic layer 510.

Again, a cable attached to a connector insert that is inserted in a connector receptacle of an electronic device may undergo various inadvertent forces. It may be desirable these inadvertent forces do not cause damage to either the connectors or the electronic device. Accordingly, these and other embodiments of the present invention may provide a connector insert that may disconnect from a connector receptacle after receiving a non-axial force. An example is shown in the following figures.

Figure 8:
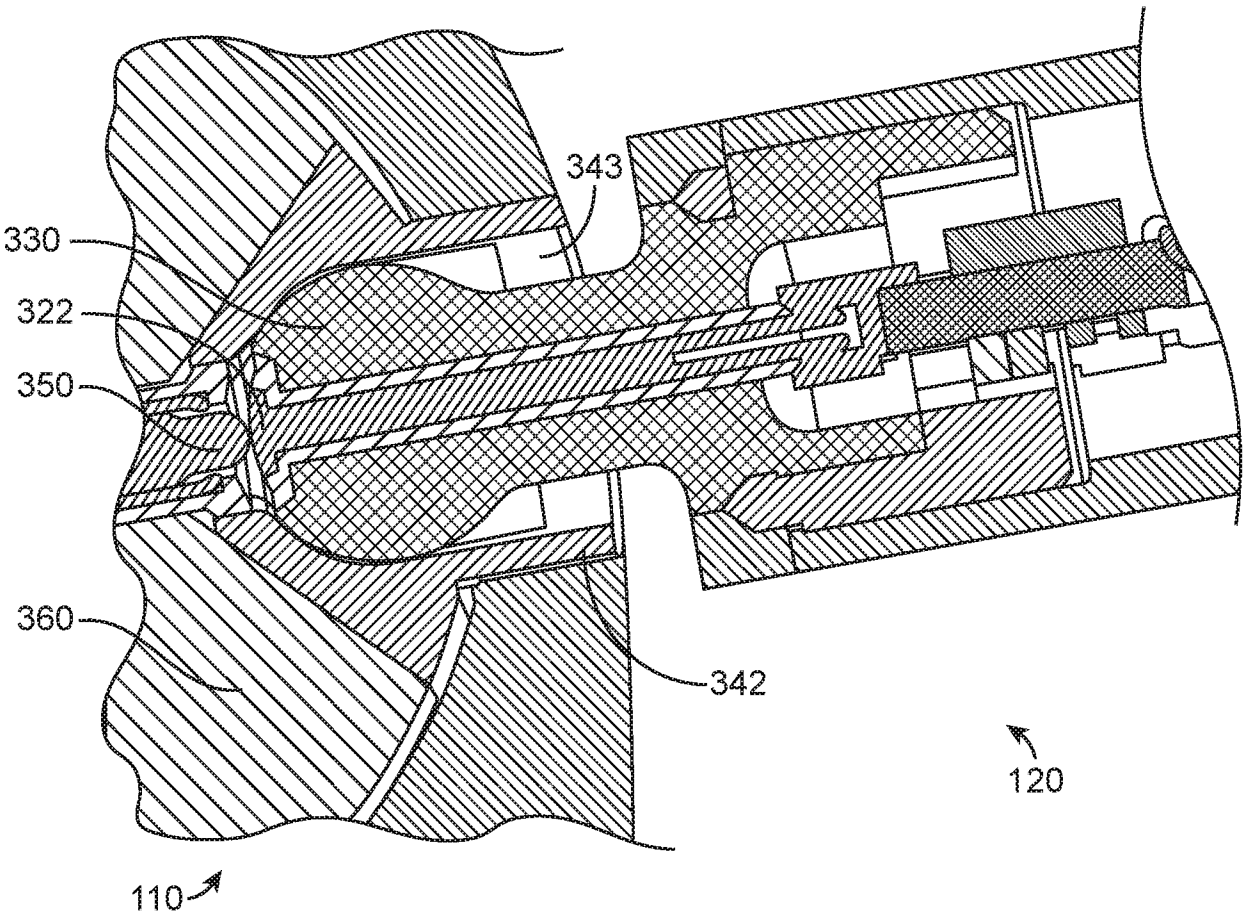
FIGS. 8-10 illustrate a disconnect sequence according to an embodiment of the present invention.
Figure 9:
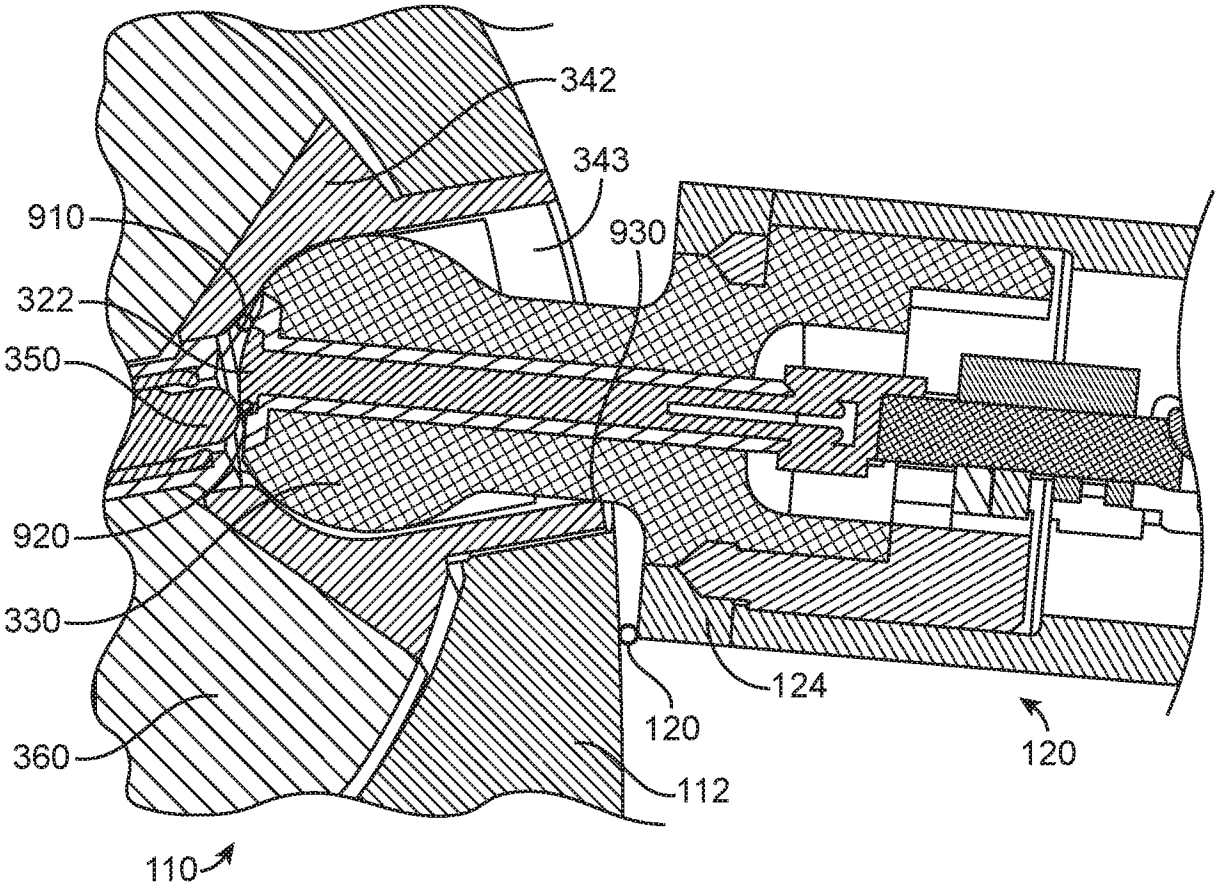
Figure 10:
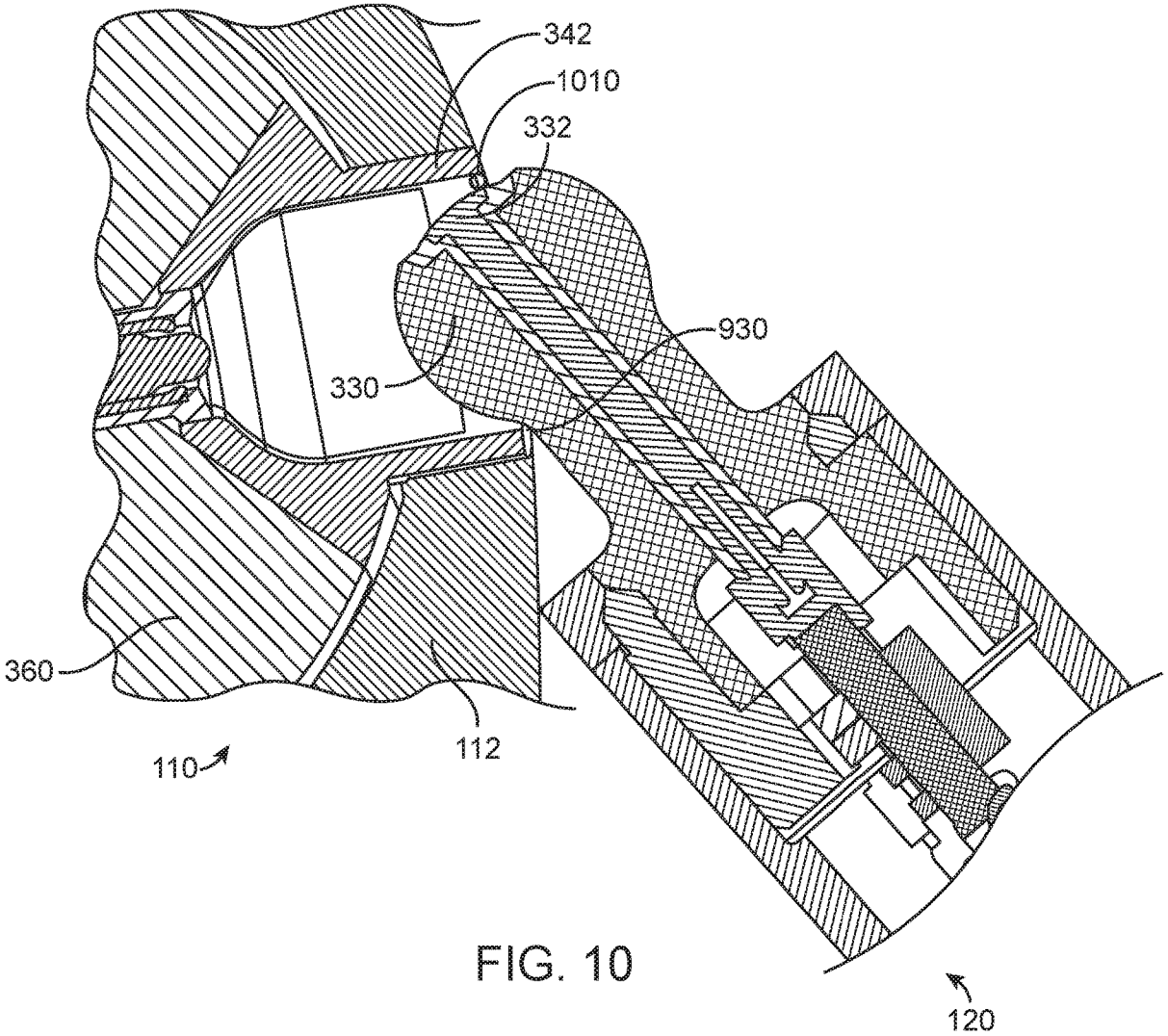

FIGS. 8-10 illustrate a disconnect sequence according to an embodiment of the present invention. In FIG. 8, a connector insert 120 is inserted into a connector receptacle 110. In this example, contact 322 of connector insert 120 may electrically connect to spring-loaded contact 350 and connector receptacle 110. Spring-loaded contact 350 may be located in opening 343 in front portion 342 of yoke 500 (shown in FIGS. 5 and 6.) In FIG. 9, a non-axial force has moved connector insert 120 relative to connector receptacle 110. A portion of connector tip 330 may engage a corner of front portion 342 of yoke 500 at location 930. Contact 322 (which may convey a power supply) of connector insert 120 may remain in contact with a tip of spring-loaded contacts 350 at location 920. Contacts 322 may have clearance 910 and might not be in electrical contact with the return path formed by front portion 342 of yoke 500. In FIG. 10, this rotation may continue and connector insert 120 may exit connector receptacle 110. That is, connector tip 330 of connector insert 120 may continue to rotate about location 930. Contact 332, which again may convey power, may maintain clearance 1010 from front portion 342 of yoke 500 and not form in electrical connection between a power supply at contact 332 and ground at front portion 342 of yoke 500. Again, non-ferritic ring 520 of yoke 500 (shown in FIG. 5) may limit flux near a front of front portion 342. This not only may help to prevent connector insert 120 from attaching to a front of device enclosure 112, but may allow connector insert 120 to easily escape connector insert 120 when it reached this point.

In these and other embodiments of the present invention, the above camming or fulcrum action may act to help sweep debris and other material out of connector receptacle 110. In these and other embodiments of the present invention, a reservoir for such debris may be included in connector receptacle 110.

In these and other embodiments of the present invention, spring-loaded contact 350 may be located in connector receptacle 110. In these and other embodiments of the present invention, a spring-loaded contact, such as spring-loaded contact 350, may be located in connector insert 120.

In various embodiments of the present invention, plungers, contacts, brackets, barrels, and other conductive portions of a connector receptacles and connector inserts may be formed by stamping, forging, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material.

The nonconductive portions, such as the housings and other structures may be formed using injection or other molding, 3-D printing, machining, or other manufacturing process. The nonconductive portions may be formed of silicon or silicone, rubber, hard rubber, plastic, nylon, liquid-crystal polymers (LCPs), ceramics, or other nonconductive material or combination of materials. The magnets may be rare-earth magnets or other type of magnets.

Embodiments of the present invention may provide connector receptacles and connector inserts that may be located in, may connect to, or may be on the surface of various types of devices, such as portable computing devices, tablet computers, desktop computers, laptops, all-in-one computers, wearable computing devices, cell phones, smart phones, media phones, storage devices, portable media players, navigation systems, monitors, power supplies, video delivery systems, adapters, styluses, remote control devices, chargers, and other devices. These connector receptacles and connector inserts may provide pathways for signals that are compliant with various standards such as one of the Universal Serial Bus standards including USB Type-C, High-Definition Multimedia Interface, Digital Visual Interface, Ethernet, DisplayPort, Thunderbolt, Lightning, Joint Test Action Group, test-access-port, Directed Automated Random Testing, universal asynchronous receiver/transmitters, clock signals, power signals, and other types of standard, non-standard, and proprietary interfaces and combinations thereof that have been developed, are being developed, or will be developed in the future. Other embodiments of the present invention may provide connector receptacles and connector inserts that may be used to provide a reduced set of functions for one or more of these standards. In various embodiments of the present invention, these connector receptacles and connector inserts may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector system comprising:
a connector receptacle comprising:
a yoke comprising:
a top ferritic layer;
an intermediate non-ferritic layer; and
a bottom ferritic layer, the intermediate non-ferritic layer between the top ferritic layer and the bottom ferritic layer,
wherein the yoke has an opening at a front of the connector receptacle; and
a connector insert having a tip to fit in the opening in the yoke when the connector insert and the connector receptacle are mated, wherein the tip is primarily formed of a ferritic material.

2. The connector system of claim 1 further comprising a magnet in the yoke between the top ferritic layer and the bottom ferritic layer.

3. The connector system of claim 2 wherein the top ferritic layer and the bottom ferritic layer are Iron-Cobalt layers.

4. The connector system of claim 2 wherein the top ferritic layer, the intermediate non-ferritic layer, and the bottom ferritic layer are laminated together.

5. The connector system of claim 2 wherein the top ferritic layer, the intermediate non-ferritic layer, and the bottom ferritic layer are brazed together.

6. The connector system of claim 2 wherein the connector receptacle further comprises a spring-loaded contact located in a passage in the yoke.

7. The connector system of claim 6 wherein the opening in the yoke at a front of the connector receptacle comprises a ring of the intermediate non-ferritic layer.

8. The connector system of claim 2 wherein the top ferritic layer and the bottom ferritic layer are arranged to convey magnetic field lines between the magnet and the tip of the connector insert when the connector insert and the connector receptacle are mated.

9. The connector system of claim 2 wherein the top ferritic layer and the bottom ferritic layer are arranged to have an increasing thickness towards a front of the connector receptacle.

10. A connector system comprising:
a connector receptacle having a front passage defining a front opening, the front passage comprising a ferritic portion and a non-ferritic ring between the front opening and the ferritic portion; and
a connector insert to fit in the front opening of the connector receptacle when the connector insert and the connector receptacle are connected,
wherein the connector insert mates with the connector receptacle along a connection axis,
wherein the connector insert may rotate 360 degrees around the connection axis without disconnecting from the connector receptacle, and
wherein the connector insert may tilt at least 10 degrees relative to the connection axis without disconnecting from the connector receptacle.

11. The connector receptacle of claim 10 wherein the connector insert may tilt at least 15 degrees relative to the connection axis without disconnecting from the connector receptacle.

12. The connector receptacle of claim 10 wherein the connector insert may tilt at least 20 degrees relative to the connection axis without disconnecting from the connector receptacle.

13. A connector system comprising:
a connector receptacle comprising:
a magnetic yoke having an opening at a front of the connector receptacle; and
a spring-loaded contact in a passage in the magnetic yoke and having a tip at the front opening of the connector receptacle; and
a connector insert comprising:
a tip to fit in the opening in the magnetic yoke when the connector insert and the connector receptacle are mated, wherein the tip is primarily formed of a ferritic material,
wherein the tip comprises a conductive path having a contacting surface at a front of the tip, and wherein the magnetic yoke comprises:
a top ferritic layer;
an intermediate non-ferritic layer; and
a bottom ferritic layer, the intermediate non-ferritic layer between the top ferritic layer and the bottom ferritic layer.

14. The connector system of claim 13 further comprising a magnet between the top ferritic layer and the bottom ferritic layer.

15. The connector system of claim 14 wherein the top ferritic layer and the bottom ferritic layer are arranged to convey magnetic field lines between the magnet and the tip of the connector insert.

16. The connector system of claim 15 wherein the top ferritic layer and the bottom ferritic layer are Iron-Cobalt layers.

17. The connector system of claim 16 wherein the intermediate non-ferritic layer is formed of stainless steel.

18. The connector system of claim 13 wherein the top ferritic layer, the intermediate non-ferritic layer, and the bottom ferritic layer are laminated together.

19. The connector system of claim 13 wherein the top ferritic layer, the intermediate non-ferritic layer, and the bottom ferritic layer are brazed together.

* * * * *